United States Patent [19]

Smith

[11] Patent Number: 4,681,071

[45] Date of Patent: Jul. 21, 1987

[54] METHOD AND APPARATUS FOR STARTING A DIESEL ENGINE AT A SUBFREEZING TEMPERATURE

[76] Inventor: Robert J. Smith, 6N091 Denker Rd., St. Charles, Ill. 60174

[21] Appl. No.: 805,511

[22] Filed: Dec. 5, 1985

[51] Int. Cl.[4] ..... F02N 17/08

[52] U.S. Cl. ..... 123/180 R; 123/567; 123/585

[58] Field of Search ..... 123/179 R, 179 G, 180 R, 123/145 A, 567, 585, 491, 26

[56] References Cited

U.S. PATENT DOCUMENTS

| | | | |
|---|---|---|---|
| 1,496,951 | 6/1924 | Shinkle | 123/531 |
| 2,715,395 | 8/1955 | Finvold | 123/1 A |
| 3,774,391 | 11/1973 | Puttick | 123/567 X |
| 3,877,450 | 4/1975 | Meeks | 123/567 |
| 3,961,609 | 6/1976 | Gerry | 123/567 |
| 4,078,535 | 3/1978 | Shafer | 123/585 X |
| 4,162,668 | 7/1979 | Jacob et al. | 123/585 X |
| 4,240,381 | 12/1980 | Lowther | 123/26 |
| 4,376,423 | 3/1983 | Knapstein | 123/585 X |
| 4,459,948 | 7/1984 | Bauer | 123/145 A |

FOREIGN PATENT DOCUMENTS

| | | | |
|---|---|---|---|
| 2806763 | 8/1979 | Fed. Rep. of Germany . | |
| 0138240 | 8/1983 | Japan | 123/491 |

*Primary Examiner*—Willis R. Wolfe, Jr.

[57] ABSTRACT

Method and apparatus for starting a glow-plug assisted diesel engine at a subfreezing temperature involves directing a flow of concentrated oxygen at a predetermined rate and pressure to the intake manifold of the diesel engine. The concentrated oxygen flow is directed directly into the intake manifold to fill the intake manifold with a high concentration of oxygen. When drawn into the firing chamber of the engine, the high concentration of oxygen is compressed during the compression stroke of the engine. Fuel is injected into the chamber with the compressed oxygen and ignited to start the engine.

22 Claims, 2 Drawing Figures

METHOD AND APPARATUS FOR STARTING A DIESEL ENGINE AT A SUBFREEZING TEMPERATURE

TECHNICAL FIELD

This invention relates generally to diesel engines and, more particularly, to method and apparatus for starting a glow-plug assisted diesel engine at a subfreezing temperature.

BACKGROUND OF THE INVENTION

Diesel engines become increasingly difficult to start as the temperature falls below freezing. It is not always convenient to keep the engine in a heated area or to raise the temperature of the engine with the use of engine block or oil heaters. The use of ether as a starting agent is dangerous because of engine pre-ignition and possible backfiring. When the engine is very cold and stiff, ether may not be effective at all.

Since the diesel engine typically has a battery-operated starter, there is the disadvantage that as the battery becomes colder, it loses efficiency. Thus, the starter turns the engine much more slowly than is desirable, and the compression strokes become so slow that much of the heat of compression is lost into the cold cylindar wall and piston. The resulting compressed air temperature is too low to ignite the injected diesel fuel. Even though glow-plug assisted diesel engines start easier than compression-start diesel engines, as the temperature continues to drop below freezing, the glow-plug assisted diesel will also fail to start at some subfreezing temperature. This is due to several factors such as the concentration of nitrogen in air inhibiting the oxidation of atomized fuel in the firing chamber and the poor atomization of low visiosity fuel at subfreezing temperatures.

SUMMARY OF THE INVENTION

The foregoing problems are solved and a technical advantage is achieved by method and apparatus for starting a glow-plug assisted diesel engine at a subfreezing temperature. A flow of concentrated oxygen is delivered at a predetermined rate and a predetermined pressure to the intake manifold of the diesel engine. The concentrated oxygen flow is directed directly into the intake. manifold to fill the intake manifold with a predetermined amount of oxygen higher than the amount of oxygen in air available to the engine.

In one illustrative embodiment of the invention, apparatus delivers a flow of concentrated oxygen to the intake manifold of a diesel engine to establish a high concentration of oxygen in the manifold prior to engaging the starter. With a high concentration of oxygen in the intake manfold, the starter is engaged to draw the high concentration of oxygen in the intake manifold into the firing chamber during the intake stroke of the engine. At the end of the compression stroke, fuel is injected into the firing chamber to ignite with the high concentration of oxygen compressed therein. Since the normally high concentration of nitrogen in air has been reduced significantly and replaced with a high concentration of oxygen in the firing chamber, the glow-plug in the firing chamber easily ignites the injected fuel and compressed oxygen. The usual weak power strokes typical of a diesel engine at subfreezing temperatures are now replaced by the strong power strokes typical of a diesel engine at normal operating temperatures. This enables the glow-plug assisted diesel to reach a running speed quickly where the rapid compression of the intake air in the compression stroke will heat the air and fuel sufficiently for normal operation without the assistance of the glow plug. Should the operator allow the engine speed to slow down and cause the engine to misfire, the addition of concentrated oxygen to the intake air will cause an immediate recovery.

In accordance with one feature of this invention, a supply of concentrated oxygen is stored in a container conveniently mounted in a safe position close to the engine.

In accordance with another feature of this invention, the delivery of the concentrated oxygen flow to the intake manifold includes controlling the rate of the concentrated oxygen flow from the concentrated oxygen supply, with the use of a flow rate control valve, for example.

In accordance with yet another feature of this invention, the delivery of the concentrated oxygen flow to the intake manifold includes regulating the pressure of the concentrated oxygen flow from the concentrated oxygen supply with the use of a pressure regulator, for example.

In accordance with still another feature of this invention, the concentrated oxygen flow is directed by a director assembly directly into the intake manifold in the same direction available air would enter the intake manifold.

DETAILED DESCRIPTION

Figure 1:
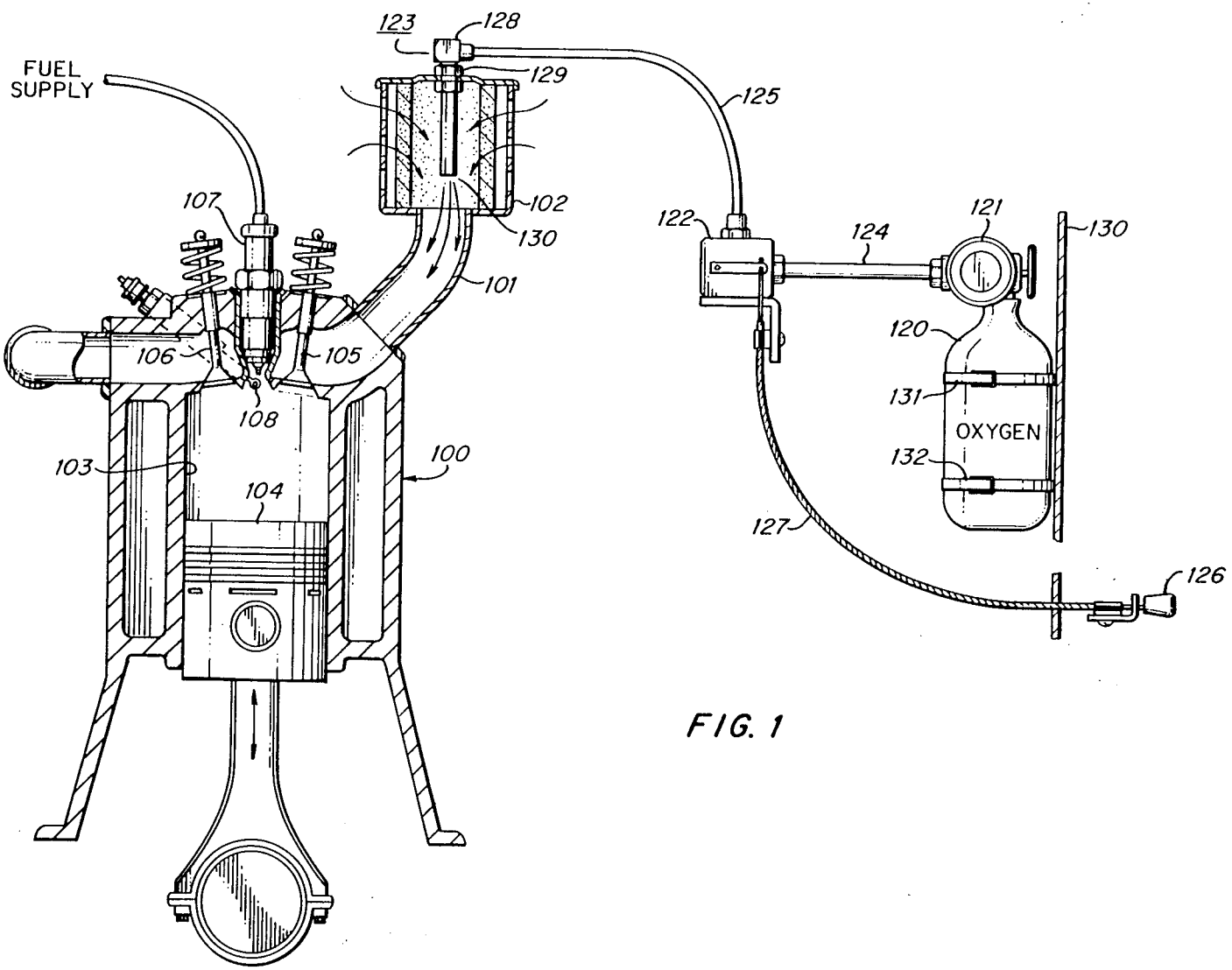
FIG. 1 depicts illustrative apparatus for starting a glow-plug assisted diesel engine at a subfreezing temperature.

FIG. 1 depicts illustrative apparatus for starting a glow-plug assisted diesel engine 100 at subfreezing temperatures such as below 32° Fahrenheit, or in particular, at those sub-freezing temperatures a glow-plug assisted diesel engine would normally fail to start. As shown in the partial cross-section view, this well-known engine includes, amongst other things, intake manifold 101 for directing air and a concentrated gaseous oxygen flow from intake filter assembly 102 into firing chamber 103. The apparatus for starting this engine at a subfreezing temperature includes oxygen container 120, pressure regulator valve 121, manually adjustable flow rate control valve 122, director assembly 123, and supply lines 124 and 125, which are all commercially available components. Oxygen container 120 stores a supply of concentrated oxygen approximately 100 percent concentration at pressures higher than the atmospheric pressure of the air available to the engine and is conveniently mounted in a safe position to a nearby structure such as wall 130 of a motorized vehicle. Oxygen container 120 is mounted using any suitable mounting fixture such as straps 131 and 132.

Pressure regulator valve 121 and adjustable flow rate control valve 122 control the respective pressure and rate of a concentrated gaseous oxygen flow from container 120 delivered to intake filter assembly 102 via supply lines 124 and 125. Director assembly 123 directs the concentrated oxygen flow directly into intake manifold 101 in the same direction as air would be drawn into the manifold through the intake filter assembly. The concentrated oxygen flow is directed directly into the manifold at a pressure and rate to force most of the air out of the manifold and fill the manifold with a much higher concentration of oxygen than found in air. Thus, with a concentrated gaseous oxygen flow being directed directly into the manifold for a brief period of time such as 2 to 4 seconds before the engine is started, the concentration of oxygen in the intake manifold is very high such as approaching 80 percent or more. To start the engine at subfreezing temperatures, the high concentration of oxygen in the intake manifold is drawn into and compressed in firing chamber 103 with piston 104 powered by a starter motor (not shown). When this high concentration of oxygen is fully compressed, injector 107 injects fuel into chamber 103 which will readily ignite with the aid of glow plug 108 to briskly start the cold engine. As shown, adjustable pressure regulator valve 121 is attached to the opening of container 120 to reduce and regulate the pressure of the concentrated gaseous oxygen flow from container 120 to adjustable control valve 122 via supply line 124. Adjustable control valve 122 controls the rate of the concentrated oxygen flow to intake manifold 101 via director assembly 123 and oxygen supply line 125. The concentrated oxygen flow between supply lines 124 and 125 can be turned on and off or adjusted anywhere inbetween by manually operating control knob 126. Control knob 126 is conveniently mounted such as in the passenger compartment of a vehicle to permit the operator to control the flow of concentrated oxygen delivered to intake manifold 101 prior to and after starting the engine. Control knob 126 is connected to adjustable control valve 122 via control cable 127.

Director assembly 123 directs the concentrated oxygen flow from supply line 125 directly into the opening of intake manifold 101. As shown, director assembly 123 is mounted through the cover of intake filter assembly 102 to direct the concentrated oxygen flow from supply line 125 directly into the opening of intake manifold 101. Director assembly 123 comprises elbow connector 128, directional coupler 129, and director tube 130 which are all well-known and commercially available components. Director tube 130 directs the concentrated oxygen flow directly into the opening of intake manifold 101 in the same direction that air would enter through intake filter assembly 102. Diesel engine 100, as previously suggested, includes piston 104 for drawing a predetermined amount or a high concentration of oxygen in intake manifold 101 into firing chamber 103 with intake valve 105 open and exhaust valve 106 closed during the intake stroke of the engine. With a high concentration of oxygen drawn into chamber 103, intake valve 105 closes with piston 104 in a complete down position as shown. Piston 104 moves in an upward position during the compression stroke of the engine to compress and heat the oxygen enclosed in firing chamber 103. When the compression stroke is completed and the oxygen compressed, injector 107 injects droplets of fuel oil into the firing chamber in a well-known manner. The injected fuel when ignited by glow plug 108 explodes and forces piston 104 in a downward direction to start the engine.

By way of example, several experiments with this method and apparatus for starting a glow-plug assisted diesel engine at subfreezing temperatures were conducted on a 1977 240D Mercedes Benz automobile having a four-cylinder diesel engine. Equipped with a well-known glow plug to assist the starting of the engine, the engine was unable to start at temperatures below 15° Fahrenheit. The engine and a supply of oxygen were kept outdoors for at least four days with temperatures well below 0° Fahrenheit. With the engine at approximately −8° Fahrenheit, a flow of concentrated oxygen at 30 lbs./sq. inches of pressure was delivered to the intake filter assembly and directly into the intake manifold of the engine for appoximately four seconds before the starter motor was engaged. The starter was then engaged, and the engine started briskly and with full power strokes. Before the engine heated up to normal operating temperatures, the amount of the concentrated oxygen to the intake manifold was decreased. When the speed of the engine was reduced, the engine started to misfire and lost power. The supply of oxygen was partially restored, and the engine speed accelerated briskly with full power strokes. When the engine again reached a brisk running speed, the oxygen supply was shut off, and the engine continued to operate in a normal manner.

Figure 2:
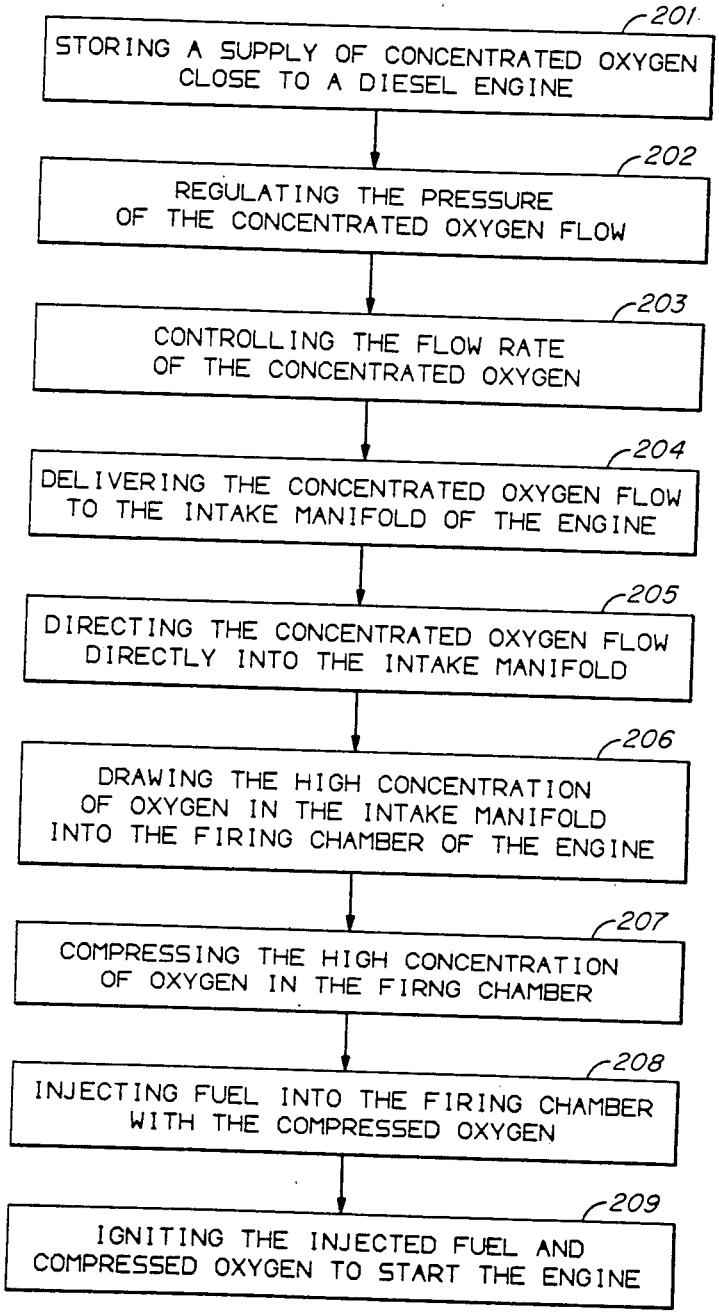
FIG. 2 is a flow diagram illustrating the method of starting a glow-plug assisted diesel engine at a subfreezing temperature.

Depicted in FIG. 2 is a flow diagram illustrating the method of starting a glow-plug assisted diesel engine at subfreezing temperatures. As indicated in block 201 of FIG. 2, a supply of concentrated oxygen is stored in a container such as 120 which is conveniently mounted in a safe position close to diesel engine 100. Pressure regulator valve 121 controls the pressure of the concentrated oxygen flow delivered from container 120 to the intake manifold (block 202). A flow of concentrated oxygen from the container is delivered to intake manifold 101 of the engine when adjustable control valve 122 is operated to a "full on" position. This is accomplished when the operator of the engine pulls control knob 126 to a fully extended position to allow concentrated oxygen to flow unrestricted from container 120 into intake manifold 101 (block 203). Adjustable control valve 122 controls the flow rate at which concentrated oxygen is delivered to intake manifold 101 to force air out of the manifold and fill the manifold with a high concentration of oxygen (block 204). Director assembly 123 directs the concentrated oxygen flow from supply line 125 directly into intake manifold 101 in the same direction that air would enter through intake filter assembly 102 (block 205). The directed concentrated oxygen forces the air out of the intake manifold and fills the manifold with an amount of oxygen much greater than that found in air. This high concentration of oxygen in intake manifold 101 permits glow-plug assisted diesel engine 100 to start easily at a subfreezing temperature.

To start the diesel engine, the high concentration of oxygen in intake manifold 101 is drawn into firing chamber 103 by opening intake valve 105 and operating piston 104 in a downward position during the intake stroke of the engine (block 206). With piston 104 positioned in a full down position, as shown in FIG. 1, intake valve 105 is closed to enclose the high concentration of oxygen in the firing chamber. As is well-known, a battery-operated starter motor operates the piston in an up and down direction to start the diesel engine. With the firing chamber closed, the piston is forced in an upward direction compressing the high concentration of oxygen drawn into the firing chamber (block 207). At the end of the compression stroke with the piston at the top of the firing chamber, injector 107 injects fine droplets of fuel into the firing chamber with the compressed oxygen therein (block 208). Glow plug 108 ignites the injected fuel and compressed oxygen to start the engine (block 209).

A concentrated oxygen flow is directed into the intake manifold 101 until the diesel engine reaches a brisk operating speed. At a brisk operating speed, a high concentration of oxygen is no longer needed to maintain the operation of the engine. Thus, the operator of the engine may then manually operate control knob 126 to shut off the flow of concentrated oxygen from container 120 to intake manifold 101.

What is claimed is:

1. Method of starting a glow-plug assisted diesel engine at a subfreezing temperature, said diesel engine having an intake manifold, comprising the steps of:

delivering a flow of concentrated oxygen at a predetermined rate and a predetermined pressure to said intake manifold; and directing said concentrated oxygen flow directly into said intake manifold to fill said manifold with a predetermined amount of oxygen higher than the amount of oxygen in air available to said diesel engine for drawing said predetermined amount of oxygen into said diesel engine during an intake stroke of said diesel engine.

2. The method of claim 1 wherein said step of directing said concentrated oxygen flow includes directing said concentrated oxygen flow into said intake manifold in the same direction as said available air would enter said intake manifold.

3. The method of claim 1 wherein said method further comprises the step of storing a supply of said concentrated oxygen.

4. The method of claim 3 wherein said step of delivering said concentrated oxygen flow to said intake manifold includes the step of controlling the rate of said concentrated oxygen flow from said concentrated oxygen supply.

5. The method of claim 3 wherein said step of delivering said concentrated oxygen flow to said intake manifold further includes the step of regulating the pressure of said concentrated oxygen flow from said concentrated oxygen supply.

6. Apparatus for starting a glow-plug assisted diesel engine at a subfreezing temperature, said diesel engine having an intake manifold comprising means for delivering a flow of concentrated oxygen at a predetermined rate and a predetermined pressure to said intake manifold; and means for directing said concentrated oxygen flow directly into said intake manifold to fill said intake manifold with a predetermined amount of oxygen higher than the amount of oxygen in air available to said diesel engine for drawing said predetermined amount of oxygen into said diesel engine during an intake stroke of said diesel engine.

7. The apparatus of claim 6 wherein said means for directing said concentrated oxygen flow includes means for directing said concentrated oxygen flow into said intake manifold in the same direction as said available air would enter said intake manifold.

8. The apparatus of claim 6 wherein said means for delivering said concentrated oxygen flow includes container means for storing a supply of concentrated oxygen.

9. The apparatus of claim 8 wherein said means for delivering said concentrated oxygen flow further includes regulator means for regulating the pressure of said concentrated oxygen flow from said concentrated oxygen supply.

10. The apparatus of claim 8 wherein said means for delivering said concentrated oxygen flow further includes valve means for controlling the rate of said concentrated oxygen flow from said concentrated oxygen supply.

11. Method of starting a diesel engine at a subfreezing temperature, said engine having an intake manifold and a firing chamber, said firing chamber having a glow plug, comprising the steps of:

directing a flow of concentrated oxygen directly into said intake manifold to fill said intake manifold with a predetermined amount of oxygen higher than the amount of oxygen in air available to said engine;

drawing said predetermined amount of oxygen in said intake manifold into said firing chamber during an intake stroke of said diesel engine;

compressing said predetermined amount of oxygen in said firing chamber;

injecting fuel into said firing chamber; and igniting said compressed oxygen and said injected fuel with said glow plug to start said engine.

12. The method of claim 11 wherein said step of directing said concentrated oxygen flow includes directing said concentrated oxygen flow into said manifold in the same direction as said available air would enter said intake manifold.

13. The method of claim 11 wherein said method further comprises the step of delivering said concentrated oxygen flow to said engine at a predetermined pressure and a predetermined rate.

14. The method of claim 13 wherein said step of delivering said concentrated oxygen flow includes storing a supply of said concentrated oxygen.

15. The method of claim 14 wherein said step of delivering said concentrated oxygen flow includes regulating the pressure of said concentrated oxygen flow from said concentrated oxygen supply.

16. The method of claim 14 wherein said step of delivering said concentrated oxygen flow includes controlling the rate of said concentrated oxygen flow from said concentrated oxygen supply.

17. Apparatus for starting a diesel engine at a subfreezing temperature, said engine having an intake manifold and a firing chamber, comprising:

means for directing a flow of concentrated oxygen directly into said intake manifold to fill said intake manifold with a predetermined amount of oxygen higher than the amount of oxygen in air available to said engine;

means for drawing said predetermined amount of oxygen in said intake manifold into said firing chamber during an intake stroke of said diesel engine;

means for compressing said predetermined amount of oxygen in said firing chamber;

means for injecting fuel into said firing chamber; and means for igniting said compressed oxygen and said injected fuel to start said engine.

18. The apparatus of claim 17 wherein said means for directing said concentrated oxygen flow includes means for directing said concentrated oxygen flow in said manifold in the same direction as said available air would enter said manifold.

19. The apparatus of claim 17 wherein said apparatus further comprises means for delivering said concentrated oxygen flow to said engine at a predetermined pressure and a predetermined rate.

20. The apparatus of claim 19 wherein said means for delivering said concentrated oxygen flow includes means for storing a supply of said concentrated oxygen.

21. The apparatus of claim 20 wherein said means for delivering said concentrated oxygen flow further includes means for regulating the pressure of said concentrated oxygen flow from said concentrated oxygen supply.

22. The apparatus of claim 20 wherein said means for delivering said concentrated oxygen flow still further includes means for controlling the rate of said concentrated oxygen flow from said concentrated oxygen supply.

* * * * *